US005077992A

United States Patent [19]

Su

[11] Patent Number: 5,077,992

[45] Date of Patent: Jan. 7, 1992

[54] DOOR LOCK SET WITH SIMULTANEOUSLY RETRACTABLE DEADBOLT AND LATCH

[76] Inventor: Frank Su, c/o Hung Hsing Patent Service Center, P.O. Box 55-1670, Taipei (10477), Taiwan

[21] Appl. No.: 714,372

[22] Filed: May 28, 1991

[51] Int. Cl.[5] ..... E05B 59/00

[52] U.S. Cl. ..... 70/107; 70/DIG. 42; 292/36

[58] Field of Search ..... 70/107, 108-111, 70/103, DIG. 42; 292/36, DIG. 62

[56] References Cited

U.S. PATENT DOCUMENTS

| | | | |
|---|---|---|---|
| 2,039,124 | 4/1936 | Stryker | 292/36 X |
| 3,390,558 | 7/1968 | Tornoe et al. | 70/107 |
| 4,129,019 | 12/1978 | Urdal | 70/107 |
| 4,809,526 | 3/1989 | Shen | 70/107 |
| 4,864,835 | 9/1989 | Wartian | 70/107 |
| 4,995,248 | 2/1991 | Liu | 70/107 |

FOREIGN PATENT DOCUMENTS 103863 9/1988 Taiwan .

*Primary Examiner*—Lloyd A. Gall

[57] ABSTRACT

A door lock includes a driving cam secured to a first spindle operatively retracting a latch, a follower cam secured to a second spindle operatively retracting a dead bolt and a linking rod having a first pin formed on a rod end pivotally connected with a cam protrusion formed on the driving cam and having a second pin formed on the other rod end slidably moving in an arcuate slot in the follower cam, whereby upon a rotation of an inside knob for rotating the driving cam for retracting the latch, the linking rod will be biased to pull the follower cam for rotating the follower cam to retract the dead bolt for simultaneously retracting both the deadbolt and the latch for opening a door smoothly, quickly and safely.

4 Claims, 4 Drawing Sheets

DOOR LOCK SET WITH SIMULTANEOUSLY RETRACTABLE DEADBOLT AND LATCH

BACKGROUND OF THE INVENTION

A "linking lock" of Taiwan Utility Model patent application No. 75203820 laid open on Taiwan Patent Gazette of Sept. 21, 1988 issue, Pages 503, 504 with a publication No. 103863 disclosed a door lock provided with an upper thumbturn 21 for retracting an upper dead bolt and a lower knob 11 for retracting a lower latch for opening a door inside the door.

If the upper dead bolt is extended outwardly for closing or locking the door and upon a rotation of the inside lower knob 11 to rotate the lower driving plate 54, a H-shaped slide 53 will be biased and raised by the lower driving plate 54 to bias an upper driving plate 52 to retract the upper dead bolt for opening the door. This is quite important for simultaneously retracting the deadbolt and the latch for quickly opening a door especially for an emergency escape from a public building in case of a fire.

However, such a conventional door lock has the following drawbacks:

1. The H-shaped slide 53 is slidably moved in a guide casing 51 formed in a lock housing 3. For instance, for raising the H-shaped slide 53 for biasing the upper driving plate 52 for retracting the upper dead bolt as biased by the lower driving plate 54, the side "leg portions" of the H-shaped slide 53 may be frictionally resisted by two longitudinal side walls in the guide casing 51 to heavily retard the sliding movement of the slide 53, thereby delaying an emergency door opening operation.

2. The H-shaped slide 53 has a larger contact area frictionally contacting the inside surfaces of the guide casing 51 and will be frictionally held or obstructed within the casing 51 especially when contaminated or packed by dirts, dusts or pollutants in between the slide and the casing inside surface, influencing a smooth door opening operation.

3. The H-shaped slide 53 should be made to have a wider width in order to match with a larger radius of each driving plate 52, 54 to increase a force arm of a leverage of either driving plate (wheel) 52, 54 for a lighter rotation force of the knob 11 or thumbturn 21, thereby increasing the volume of the lock housing 3 and influencing its esthetic decorative effect.

The present inventor has found the drawbacks of the conventional door lock and invented the present door lock set with simpler construction but with a smooth operation.

SUMMARY OF THE INVENTION

The object of the present invention is to provide a door lock including a driving cam secured to a first spindle operatively retracting a latch, a follower cam secured to a second spindle operatively retracting a dead bolt and a linking rod having a first pin formed on a rod end pivotally connected with a cam protrusion formed on the driving cam and having a second pin formed on the other rod end slidably moving in an arcuate slot formed in the follower cam, whereby upon a rotation of an inside knob for rotating the driving cam for retracting the latch, the linking rod will be biased to pull the follower cam for rotating the follower cam to retract the dead bolt for simultaneously retracting both the deadbolt and the latch for opening a door smoothly, quickly and safely.

Another object of the present invention is to provide a door lock for simultaneously retracting both a deadbolt and a latch with simpler construction, lower production and installation cost, as well as minor maintenance problems.

DETAILED DESCRIPTION

Figure 1:
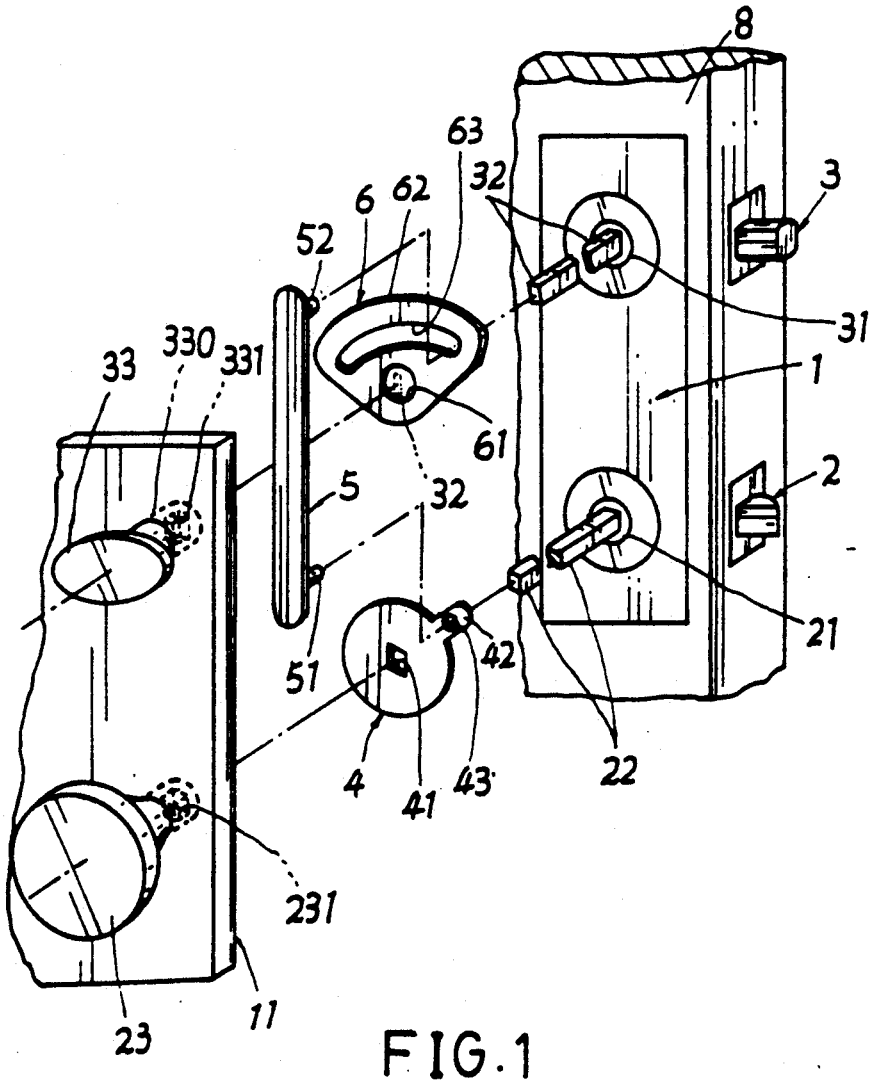
FIG. 1 is an exploded view of the present invention when viewed from inside a door.

As shown in FIGS. 1–5, the present invention comprises: a housing 1 formed in a door 8 provided for fixing a door lock thereon, a latch 2, a deadbolt 3, a driving cam 4, a linking rod 5, a follower cam 6, and a door handle 7.

The housing 1 includes: a trim plate 11 for rotatably securing an inside knob 23 of the latch 2 and an inside thumbturn 33 of the deadbolt 3 in the trim plate 11 inside the door 8, and an escutcheon 12 formed on an outside of the door 8. The handle 7 may be secured on an outside surface of the door 8 as shown in FIG. 5.

Figure 5:
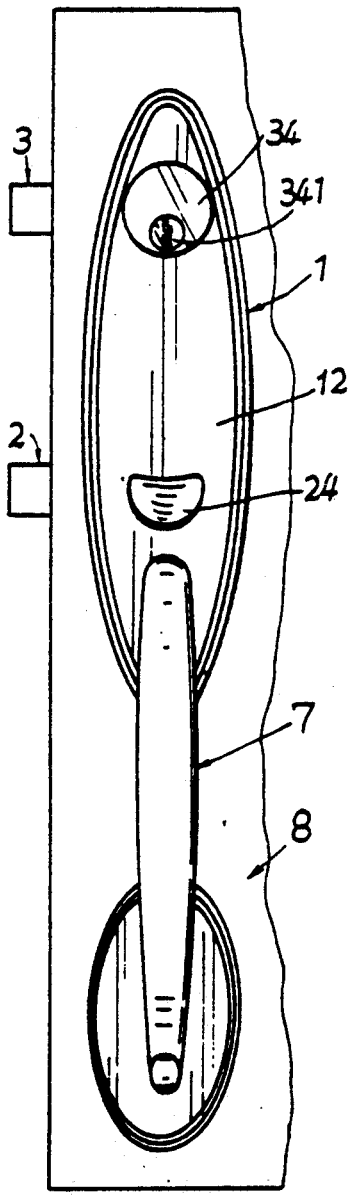
FIG. 5 shows an outside surface of the present invention when viewed from outside a door.

The latch 2 includes: a latch driving mechanism 21 for operatively extending the latch 2 outwardly for locking or closing a door 8 or retracting the latch 2 inwardly for opening the door 8, a first spindle 22 secured to the latch driving mechanism 21 and protruding towards an inside of the door 8 to be fixed with an inside knob 23 having a spindle hole 231 formed in the knob 23 for inserting the spindle 22 which is then fixed with the knob 23, and an outside lever or knob 24 formed on an outside of the door 8 as shown in FIG. 5 which may be depressed or rotated for retracting the latch 2 for opening the door.

The first spindle 22 may be formed as a square spindle as shown in FIG. 1. The latch driving mechanism 21 is a conventional device used in a conventional mortise lock or cylinder lock and is not described herewith for its detailed construction therefore.

The dead bolt 3 includes a bolt driving mechanism 31 for operatively extending the dead bolt 3 outwardly for locking or closing the door or for retracting the deadbolt 3 for opening the door, a second spindle 32 having a cross section generally rectangular shaped as shown in FIG. 1, an inside thumbturn 33 having a sleeve portion 330 protruding towards the second spindle 32 and a socket 331 engageable with the second spindle 32 for fixing the spindle 32 with the thumbturn 33, and an outside lock 34 formed in the housing 1 having a lock core 341 rotatably held in the lock 34 which is inserted therein with a key (not shown) for rotating the core 341 for actuating the bolt driving mechanism 31 for retracting the dead bolt 3 for opening the door 8.

The driving cam 4 includes: a first central hole 41 generally square shaped for passing the first spindle 22 on which the cam 4 is fixed between the trim plate 11 and the latch driving mechanism 21 provided in the housing 1, and a cam protrusion 42 protruding radially having a pin hole 43 formed in the cam protrusion 42.

The follower cam 6 includes: a second central hole 61 formed at a center portion of the cam 6 engageable with the sleeve portion 330 of the thumbturn 33 for fixing the follower cam 6 on the sleeve portion 330 and the second spindle 32, an enlarged sector portion 62 diverging radially from the center portion of the cam 6, and an arcuate slot 63 arcuately formed in the enlarged sector portion 62 of the follower cam 6 having a first slot end portion 6a and a second slot end portion 6b respectively disposed on two opposite ends of the slot 63.

The linking rod 5 generally formed as a longitudinal rod, link, bar or plate having a first pin 51 formed on one end portion of the rod 5 engageable with the pin hole 43 formed in the cam protrusion 42 of the driving cam 4, and a second pin 52 formed on the other end portion of the rod 5 opposite to the first pin 51 slidably engageable with the arcuate slot 63 formed in the follower cam 6.

A width of the arcuate slot 63 is equal to or slightly larger than a diameter of the second pin 52 for their sliding engagement with each other.

Figure 2:
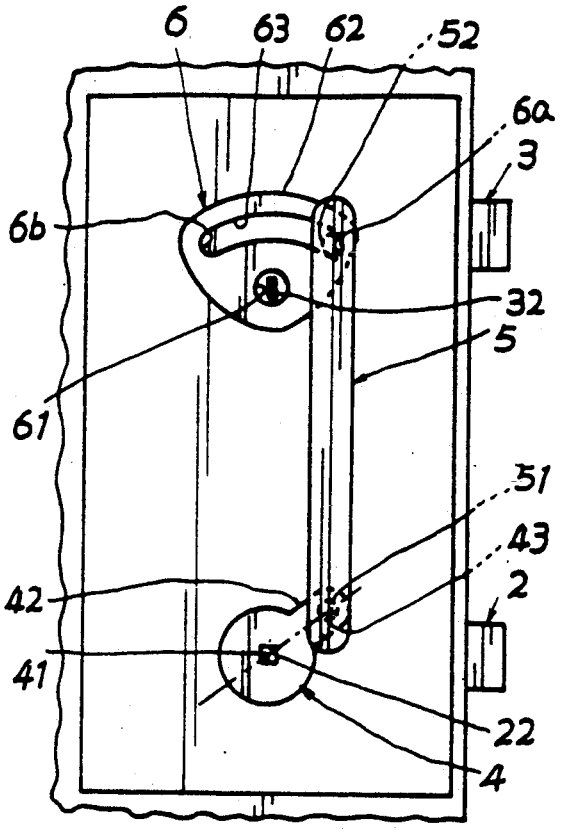
FIG. 2 is an illustration showing a protruding deadbolt and latch for closing or locking a door in accordance with the present invention.
Figure 3:
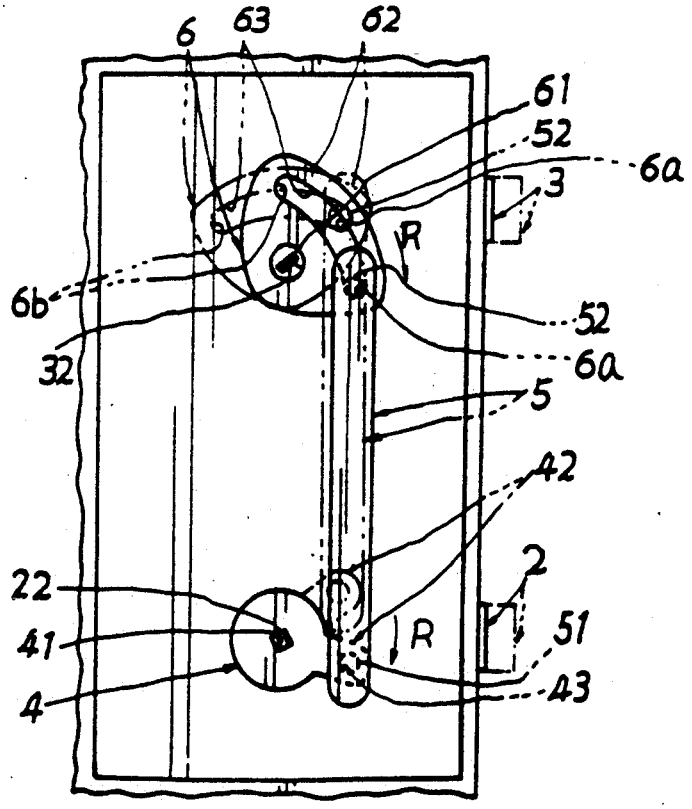
FIG. 3 shows a retraction of the deadbolt and latch for opening a door in accordance with the present invention.

When the dead bolt 3 is extended outwardly for locking the door as shown in FIG. 2, the follower cam 6 is rotated by the bolt driving mechanism 31 to move the arcuate slot 63 upwardly to be generally perpendicular to the linking rod 5 vertically erected as shown in FIG. 2 to allow the second pin 52 formed on an upper end portion of the rod 5 to engage the first slot end portion 6a which can also be designated as "lower dead point" formed on a first end portion of the arcuate slot 63 as shown in FIG. 2 to be ready for a downwardly pulling of the follower cam 6 by the linking rod 5 from FIG. 2 to FIG. 3. At this time, the cam protrusion 42 of the driving cam 4 is also raised upwardly as shown in FIG. 2 by the rod 5 to extend the latch 2 outwardly for closing or locking the door.

For opening the door, the inside knob 23 of the latch 2 is rotated (direction R) to retract the lower latch 2 as shown in FIG. 3 to rotate the cam protrusion 42 downwardly as shown in solid line of FIG. 3 to pull the linking rod 5 and the follower cam 6 downwardly to retract the upper dead bolt 3 for simultaneously retracting the latch 2 and deadbolt 3 for quickly opening the door. Since the rotation of knob 23, cam 4 and pulling of rod 5, cam 6 is acted directly and stably, the retraction of latch 2 and bolt 3 for opening the door can therefore be done so smoothly, safely and lightly.

Figure 4:
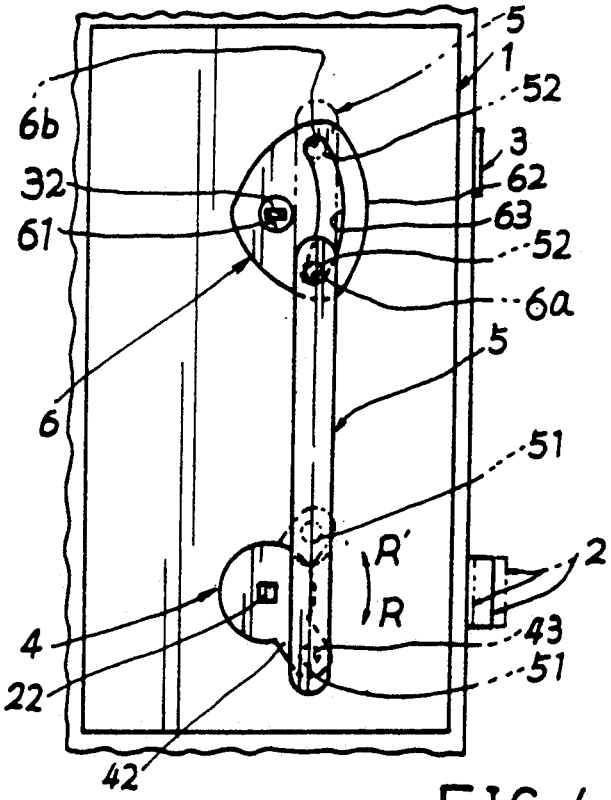
FIG. 4 shows a rotation operation of a lower latch knob without influencing the upper dead bolt when the dead bolt is retracted in accordance with the present invention.

When the dead bolt 3 is retracted as shown in FIG. 4, the lower latch 2 can be freely rotated either clockwise R or counter-clockwise R′ without being obstructed since the second pin 52 of the linking rod 5 is slidably moved (without being retarded) between the lower dead point 6a and an upper dead point 6b in the arcuate slot 63 of the follower cam 6 secured with the dead bolt 3. At this time the slot 63 is generally parallel to the linking rod 5 vertically linkingly operated. The two dead end points 6a, 6b may also be designated as a first slot end portion and a second slot end portion.

The door 8 can be opened from an outside of the door as shown in FIG. 5 by inserting a key into a key hole of the lock core 341 for rotating the core 341 for unlocking the lock 34 for retracting the deadbolt 3 and the outside lever 24 can be depressed to retract the latch 2 for opening the door. If the lever 24 is substituted with an outside knob (not shown in the drawings), the outside knob can be rotated for retracting the latch 2 for opening the door.

The present invention can be suitably modified by those skilled in the art, without departing from the spirit and scope as claimed hereinafter.

The present invention is especially superior to a conventional door lock by its simpler structure and construction so that its volume, its production cost and maintenance problems can be reduced for enhancing its commercial value and esthetic decorative effect.

I claim:

1. A door lock set comprising:

a latch having a latch driving mechanism formed in a first portion in a housing formed in a door operatively driven by an inside knob fixed on a first spindle of the latch driving mechanism inside the door for extending said latch outwardly for locking or closing the door;

a dead bolt having a bolt driving mechanism formed in a second portion in the housing operatively driven by an inside thumbturn fixed on a second spindle of the bolt driving mechanism inside the door for extending said dead bolt outwardly for locking or closing the door;

a driving cam secured on said first spindle having a cam protrusion protruding radially from said driving cam;

a follower cam secured on said inside thumbturn and said second spindle having an arcuate slot formed in an enlarged sector portion diverging from a center portion of said follower cam; and a linking rod having a first pin formed on a first end portion of said rod engageable with a pin hole formed in said cam protrusion of said driving cam and having a second pin formed on a second end portion of said rod opposite to said first pin slidably engageable with said arcuate slot in said follower cam;

said follower cam being normally raised when said dead bolt is protruded outwardly to allow said arcuate slot to be generally perpendicular to said linking rod generally vertically linked between said driving cam and said follower cam in said housing, having said second pin of said rod engaged on a first end portion of said arcuate slot of said follower cam, whereby upon a rotation of said inside knob for retracting said latch, said cam protrusion of said driving cam is biased to pull said linking rod and said follower cam to rotate said follower cam and said bolt driving mechanism for simultaneously retracting said dead bolt for opening the door.

2. A door lock set according to claim 1, wherein said follower cam defines said arcuate slot having said first slot end portion and a second slot end portion opposite to said first slot end portion for slidably moving said second pin of said linking rod between two said slot end portions allowing a free rotation of said driving cam and said inside knob for retracting or extending said latch when said dead bolt is retracted to rotate said bolt driving mechanism to bias and lower said follower cam to allow said arcuate slot to be generally parallel to said linking rod vertically linked between two said cams.

3. A door lock set according to claim 1, wherein said driving cam is secured on said first spindle having a cross section of square shape engageable with a first central hole generally square shaped formed in a central portion of said driving cam, said driving cam limited by a trim plate covering said housing inside said door having said inside knob rotatably secured on said trim plate.

4. A door lock set according to claim 1, wherein said follower cam is secured on a sleeve portion protruding from said inside thumbturn for connecting said second spindle, said follower cam having a second central hole formed at the center portion of said follower cam to be engageable with said sleeve portion of said thumbturn for fixing said follower cam on said thumbturn and said second spindle, said follower cam limited by said trim plate covering said housing for rotatably securing said thumbturn on said trim plate.

* * * * *